United States Patent [19]

Avery

[11] 3,994,717

[45] *Nov. 30, 1976

[54] METALLOTHERMIC PRODUCTION OF MAGNESIUM IN THE PRESENCE OF A SUBSTANTIALLY STATIC ATMOSPHERE OF INERT GAS

[76] Inventor: Julian Avery, 47 Old Orchard Road, Chestnut Hill, Mass. 02167

[ * ] Notice: The portion of the term of this patent subsequent to Apr. 25, 1989, has been disclaimed.

[22] Filed: July 9, 1975

[21] Appl. No.: 594,243

Related U.S. Application Data

[63] Continuation of Ser. No. 26,118, April 6, 1970, abandoned, which is a continuation-in-part of Ser. No. 796,214, Feb. 3, 1969, Pat. No. 3,658,509, which is a continuation-in-part of Ser. No. 648,856, June 26, 1967, Pat. No. 3,579,326.

[52] U.S. Cl. ..... 75/67 R; 75/10 R; 75/10 P; 75/10 A

[51] Int. Cl.[2] ..... C22B 45/00

[58] Field of Search ..... 75/67 R, 10 R, 10 P, 75/10 A

[56] References Cited

UNITED STATES PATENTS

| | | | |
|---|---|---|---|
| 2,497,096 | 2/1950 | Parry | 75/67 R |
| 2,971,833 | 2/1961 | Artru et al. | 75/10 R |
| 3,441,402 | 4/1969 | Magee et al. | 75/10 R |
| 3,520,524 | 7/1970 | Stawarz et al. | 75/67 R X |
| 3,579,326 | 5/1971 | Avery | 75/67 R |
| 3,658,509 | 4/1972 | Avery | 75/67 R |
| 3,681,053 | 8/1972 | Avery | 75/67 R |
| 3,698,888 | 10/1972 | Avery | 75/67 R |
| 3,761,248 | 9/1973 | Avery | 75/67 R |
| 3,782,922 | 1/1974 | Avery | 75/67 R |

*Primary Examiner*—G. Ozaki
*Attorney, Agent, or Firm*—Douglas E. Whitney

[57] ABSTRACT

The metallothermic reduction of magnesium oxide to magnesium by means of a metallic reducing agent in a reaction zone at elevated temperature in the presence of a molten oxidic slag, wherein the product magnesium is vaporized and evolved from the slag into a substantially static atmosphere of inert gas and passes predominately by diffusion through the inert gas from the reaction zone to a condensation zone and is collected. As a result, not only is it possible to operate the process at a higher absolute pressure than heretofore, but also, unexpectedly, the magnesium product obtained is relatively pure as compared with commercial magnesium, and contains impurities, notably silicon, in low concentration.

22 Claims, No Drawings

METALLOTHERMIC PRODUCTION OF MAGNESIUM IN THE PRESENCE OF A SUBSTANTIALLY STATIC ATMOSPHERE OF INERT GAS

Cross-references to Related Applications

This application is a continuation of application Ser. No. 26,118, filed Apr. 6, 1970, now abandoned, which in turn was a continuation-in-part of my copending application Ser. No. 796,214, filed Feb. 3, 1969, now U.S. Pat. No. 3,658,509, which in turn was a continuation-in-part of my copending application Ser. No. 648,856, filed June 26, 1967 now U.S. Pat. No. 3,579,326.

BACKGROUND OF THE INVENTION

This invention is concerned with the production of magnesium metal by the metallothermic reduction of magnesium oxide at elevated temperatures. More particularly, it relates to an improved process of the type in the prior art wherein metallic silicon, customarily in the form of a ferrosilicon alloy, and magnesium oxide, customarily in the form of calcined dolomite, are caused to react in an electric furnace-condenser system, customarily maintained under a high vacuum.

In such a process, known as the "Magnetherm" process, the oxidation of the silicon and the reduction of the magnesium oxide take place in the presence of a molten slage bath at temperatures above about 1300°–1400° C. In this process, the reaction zone is maintained under vacuum, since the magnesium product is removed from the reaction zone by distillation; see generally "Magnesium by the Magnetherm Process", C. Faure et al., J. Metals (Sept. 1964), pp. 721–23. Under the high vacuum, magnesium vapor at very low partial pressure evolves and is subsequently condensed to molten or solid magnesium metal. Periodically, "spent" ferrosilicon alloy and a large quantity of slag are tapped from the furnace in molten form. Since the furnace-condenser system is maintained under high vacuum in order to promote the desired reaction and to vaporize the magnesium product, the periodic removal of slag and spent alloy from the furnace requires that the vacuum be broken and the operation interrupted. The process is therefore essentially a batch operation.

The equipment in which such a process has been carried out comprises in sequence: feed bins in which the raw materials are stored and from which they are fed to the furnace through ducts or tubes; the furnace proper in which the reducing reaction takes place; a throat or duct through which magnesium vapor released in the reaction zone passes; a condenser in which the magnesium vapor is condensed to molten metal; and a pot or crucible attached to the condenser in which the molten magnesium is collected.

In such an operation it is necessary to remove the molten products from the system periodically. Tapping the furnace under high vacuum to remove molten slag and spent reductant is impractical, and it is difficult to remove molten magnesium from the crucible under high vacuum. The procedure used in the Magnetherm process is periodically to stop the reaction and then to break the vacuum, thus permitting the furnace to be tapped and the crucible removed. As soon as the furnace is plugged and the crucible replaced by a fresh one, vacuum is once more applied, and the operation is started again.

Such a process has been operated only on a small commercial scale, in contrast with the method now used for the production of magnesium on a large commerical scale, namely, the electrolysis of molten magnesium chloride.

Another metallothermic process for the production of magnesium, the "Pidgeon" process, is also a batch operation which has been operated only on a comparatively small commercial scale. In this process magnesium oxide, in the form of calcined dolomite, and metallic silicon, in the form of ferrosilicon, are charged into batteries of small externally heated retorts, in which a "solid state" reaction occurs at temperatures on the order of 1100°–1200° C. Under these conditions metallic magnesium is released from the reaction zone as a vapor at very low partial pressure, and it is therefore necessary to maintain the battery of retorts under very high vacuum.

In my earlier application, Pat. No. 3,658,509, there is disclosed a significant improvement to the Magnetherm process which permits operation at a relatively high pressure. An inert gas at a partial pressure of at least 0.1 atmosphere is provided above the molten slag in order in order that the absolute pressure of the system may be increased. In the development of this earlier invention, I have found not only that such operation at relatively high pressure is possible, but also that in certain instances unexpected benefits may be attained. These are the results of the instant invention, which can be characterized as an improvement upon my earlier invention.

One early reference, W. Moschel et al., "Magnesium" Chemische Technologie, vol. 5 pp. 102–64 (Winnacker & Weingartner, ed.) (1953), describes an attempted use of an inert gas, hydrogen, in the vapor space above a reaction zone where solid dolomite is reduced by silicon (p. 145). The conclusion then reached was that in such a system it was necessary to operate above the temperature at which the magnesium reaction pressure is one atmosphere, in order to carry the reaction to completion, otherwise the reaction would stop. The use of a stream of inert gas was suggested as improving the usefulness of the operating space and to permit continuous operation. It was said that the technical possibility of such a process was studied at a major laboratory in Germany, and became the subject matter of two German patents, German Pat. Nos. 666,712 and 690,714, but was discarded in favor of the vacuum method. I have found, however, that in a molten slag reaction system the use of a substantially static inert gas does not stop the reaction and results in significant improvements over the vacuum method.

A principal objective of the present invention is to decrease the concentration of silicon in the product magnesium. Magnesium as presently produced by the commerical Magnetherm process contains silicon as an impurity in a concentration of about 500–600 ppm—a level which is considered intolerably high by some experts, particularly for its use in the production of titanium, zirconium or the like. Typically, also, the Magnetherm product magnesium contains about 600 ppm manganese, 130 ppm iron, and about 250–600 ppm of remaining minor constituents, such as zinc, copper, tin, lead and nickel. It is a further objective of this invention to decrease substantially the concentration of these metallic impurities in the magnesium product.

One of the major drawbacks of the Magnetherm process, as mentioned above, is its requirement of operation under high vacuum. Many efforts have been made to adapt the process so that it may be operable at atmospheric pressure; see, e.g., my earlier applications referred to above and the Magee et al. patent, U.S. Pat. No. 3,441,402. These efforts involve in most cases variations of the magnesium ore, reducing alloy or slag composition in order to favor the principal reaction to promote magnesium formation at a higher partial pressure. Some of these changes, however, entail attendant disadvantages. For example, the reactivity of the ferrosilicon reducing alloy can be increased by the use of high purity silicon, as disclosed in my copending application filed concurently herewith, now Pat. No 3,681,053; but the increased silicon content of the alloy will, other things being equal, result in increased silicon in the magnesium product. It is therefore a further objective of this invention to permit using a high-silicon reducing alloy while at the same time decreasing the silicon content in the magnesium product.

The ferrosilicon reducing agent used in the Magnetherm process is fed to the reaction zone through a discharge pipe from which it is charged onto a highly agitated molten slag bath where the reaction takes place. Since this alloy is ground to a fairly small size, it carries with it a metallic dust. The oxidic materials fed to the reaction zone, e.g., dolomite, magnesia, bauxite or alumina, also contain dust. The conditions in the reaction zone are such that the agitation of the slag combined with the high velocity of the escaping magnesium vapor inevitably results in the carrying over of at least a small portion of this dust into the condenser, with a consequent contamination of the magnesium product.

The seriousness of this dusting problem becomes clearer upon the consideration that, under the high vacuum operation (about 7 to 35 mm. Hg) coupled with a high temperature (about 1500° C), the magnesium vapor passing through the duct connecting the furnace and the condenser may reach a velocity on the order of 100 ft. per second. Consequently, it is a further objective of this invention to decrease the tendency for metallic and oxidic dust to be carried over from the furnace to the condenser.

U.S. Pat. No. 3,017,263, issued to Bretschneider et al., describes in some detail the contamination of magnesium both from vaporized metals such as silicon and from dusting, and a proposed method to combat it, by way of passing magnesium vapor through loosely heaped lumpy material kept in movement. It is a further objective of the present invention to purify the magnesium product without the use of moving solids.

BRIEF DESCRIPTION OF THE INVENTION

In the present process magnesium oxide is reduced to magnesium by a reaction with a metallic reducing alloy or metal in a reaction zone at elevated temperature in the presence of a molten oxidic slag. The reaction zone contains a substantially static atmosphere of inert gas, and the magnesium vapor passes through said inert gas predominantly by way of diffusion into a condensation zone where it is condensed and collected. The partial pressure of the inert gas in the condensation zone is at least 0.05 atmosphere, and preferably about 0.25 to 1.0 atmosphere. Furthermore, means may be provided to control the relative flow of the inert gas from the reaction zone to the condensation zone in order to maintain desirable control over the reaction and of product quality.

As a result of this process, a unique electrothermic magnesium product is obtained substantially purer than the magnesium obtained by comparable processes. Depending upon the reaction conditions, reducing alloy and other factors, the total impurities in the magnesium product can be held to substantially less than 1500 ppm, and the silicon content of the product can be held to less than about 300 ppm, if desired.

These desirable results are attributable in part to two characteristics of the present process. First, the substantially static atmosphere of inert gas above the molten slag considerably lessens the vapor velocity from the reaction zone into the condensation zone and concomitantly diminishes the carryover of metallic and oxidic dust. Second, the substantially static inert gas provides a partial transfer barrier to the magnesium vapor, consequently requiring higher partial pressure of magnesium vapor in the reaction zone to provide the increased driving force needed. Since at a given temperature there is no equivalent partial pressure increase among the vaporized contaminants, such as silicon, in the reaction zone, their relative concentration in the vapor space in the reaction-condensation system is decreased and the magnesium product therefore contains relatively diminished amounts of these impurities.

DETAILED DESCRIPTION OF THE INVENTION

An important aspect of this invention is the unique nature of the space above the molten slag in the reaction-condensation system into which product magnesium vapor is evolved. This vapor space contains a substantially static atmosphere of inert gas, and the mass transfer of magnesium from the reaction zone to the condenser is predominately by diffusion. A result of this invention is to create conditions between the reaction zone and the condenser such that the magnesium vapor passes through, not predominately by vacuum distillation nor predominately by a sweeping stream of inert gas, but predominately by diffusion through the static inert gas.

A reaction-condensation system suitable for the present process comprises in sequence:

1. Feed bins for raw materials.

2. Pipes or ducts with suitable control mechanisms for feeding raw materials to the furnace.

3. A furnace (reaction zone) in which the reaction takes place, containing space for molten spent alloy; a molten slag bath in which the reaction occurs; a vapor space above the reaction zone; electrodes designed to cause electric current to flow through the slag bath, thus providing by the Joule effect energy required to promote the reaction; and one or more tap-holes to remove the molten slag and spent alloy.

4. A duct connecting the furnace and the condenser, through which magnesium vapor passes, so designed with respect to effective length and cross section as to permit mass transfer by diffusion without excessive pressure drop. The duct of the present Magnetherm furnace, as shown in published literature, happens to be suitable at the stated production capacity.

5. A condenser condensation zone) in which magnesium vapor is condensed to molten metal by heat transfer.

6. A receiving pot connected to the condenser which collects the molten magnesium.

7. A purge system comprising ducts, control valves, and a vacuum (or comparable) pump which by purging a portion of the inert gas exhausts to the atmosphere gases such as $H_2$ and CO, which would otherwise accumulate in the system at a slow rate.

Preferably, the system also comprises:

8. Means to remove inert gas from the condensation zone and to recycle it back to the reaction zone, including if desired means to heat the inert gas. Preferably, such means include means to control the relative flow rate of the inert gas recycled and thus indirectly the relative flow rate of the inert gas from the reaction zone to the condensation zone.

In the process of this invention inert gas can be introduced into the system at any point, but preferably it is introduced into the feed bins or the feed ducts at a slow rate just sufficient to prevent diffusion of magnesium vapor from the furnace space back into the feed ducts or pipes. The pressure of inert gas on the system is thus controlled at the desired level by suitable devices operating in conjunction with the purge pump or recycle means, if any.

Heretofore it has been supposed that removal of magnesium vapor from the reaction zone by distillation under high vacuum is necessary in order to promote the reducing reaction:

$$2MgO_{(l)} + Si_{(l)} \quad SiO_{2\,(l)} + 2Mg_{(g)} \quad (\ )$$

Thus driving the reaction from left to right, and that a relatively high absolute pressure in the system (i.e., above 0.1 atmosphere) would be detrimental; hence the use of a very high vacuum. First, it would seem that an increase in magnesium partial pressure would tend to reverse the reaction which produces the magnesium in the reaction zone. Second, it was thought that the presence of a higher total pressure, even at the same magnesium partial pressure, could inhibit the transfer of magnesium vapor through the duct and into the condenser, as well as retard the reaction.

However, in accordance with the present invention, it is believed that an absolute pressure of up to at least about one atmosphere, including the partial pressure of both magnesium and an inert gas, will not inhibit the reaction to a serious extent, and that under normal conditions gaseous diffusion alone will provide a mass transfer rate of magnesium vapor from furnace to condenser sufficient to keep pace with the rate of production in the furnace. Thus it becomes possible to operate the system under atmospheric pressure or thereabouts, or in any event at relatively high absolute pressure, i.e., above 0.1 atmosphere Some terms need definition. As employed herein, the term "inert gas" includes those gaseous materials that are nonreactive with the components of the system under the conditions of operation. Because of the high chemical activity of magnesium at elevated temperature, few gases can be considered inert in the present process. Suitable inert gases include the literally inert gases, such as helium, neon, argon and the like. Another non-reactive gas is hydrogen, which is in certain respects desirable. Hydrogen is cheap and easily available, it provides excellent characteristics for heat transfer in the condenser, and it provides a relatively high specific rate of diffusion. Because of a relatively high diffusivity of magnesium vapor through the gases of lower atomic weight, helium or hydrogen, including mixtures thereof, is preferred. A useful gas is a mixture of hydrogen or helium with up to 50 percent by volume of argon.

The partial pressure of inert gas in the system is defined as its pressure at the condenser (conveniently measured in the purge or recycle system). The partial pressure of magnesium vapor in the condenser is approximately the vapor pressure of magnesium at its melting point (about 7mm); the pressure of magnesium vapor in the furnace space is determined by the pressure drop in the duct, which also affects the pressure differential of the inert gas between the furnace and condenser. The partial pressure of the inert gas in the condensor and that of magnesium vapor in the furnace may therefore be quite different, but the total pressure on the system at any point will be at least as great as that of the inert gas in the condenser.

By "substantially static" inert gas and the passage of magnesium "predominately by diffusion", I mean that the movement of the magnesium vapor is faster than the movement, if any, of the inert gas from the reaction zone to the condenser, or that the magnesium vapor passes through the inert gas, rather than vice versa. Thus, the terms are interrelated and together meet the two conditions. But these conditions are very difficult of measurement and, in part, somewhat functional. Consequently, I prefer to define the terms in a manner more precise: the molal flow rate of the magnesium vapor to the condenser must be greater than that of the inert gas, for the inert gas to be "substantially static", and preferably at least twice as great; and the partial pressure of the inert gas in the condenser must be at least 0.05 atmosphere for the magnesium transfer to be "predominately by diffusion", and preferably at least as high as the partial pressure of the magnesium vapor in the reaction zone. For simplicity the molal flow rate of magnesium can be considered equal to the magnesium production rate (in moles); and that of inert gas, to the recycle rate (in moles) including that amount purged.

In order that the advantages of this invention to obtained, it is necessary that the inert gas be substantially static. Of course, in any vapor system the components are never absolutely static, since the molecules or atoms are continuously moving about. By "static" here I mean no net movement between the reaction zone and the condensation zone. "Substantially static" includes as well a net movement up to that of the magnesium vapor from the reaction zone to the condenser. If this latter rate is exceeded, the advantages of this invention are not obtained, and the magnesium vapor transfer would no longer be predominately by diffusion but by a sweeping, in which case the magnesium vapor partial pressure would be decreased. Similarly, without a substantial amount of inert gas present, i.e. a partial pressure in excess of 0.05 atmosphere, there can be no substantial diffusion but only distillation.

Another way better to understand this invention is to compare it with other recent developments. The published Magnetherm process entails a transfer of magnesium vapor to the condenser essentially by vacuum distillation. The "ideal" system is under high vacuum, on the order of 10mm. Hg or less, and the partial pressure drop of the magnesium vapor from the reaction zone to the condenser is so low as to be hardly measurable. The low partial pressure of magnesium vapor in the reaction zone is thought to be desirable, since it increases the reaction driving force. In view of this advantage, any increase, such as exists in this invention, to the magnesium vapor pressure would seem to be a step in the wrong direction—one tending to retard the reaction. But I have found that the magnesium vapor pressure can be increased without substantial inhibition to the reaction, and with significant and unexpectedly beneficial results. Thus, notwithstanding that vacuum distillation appears to be the ideal way to promote the reaction, I have found that a different approach—magnesium vapor diffusion through substantially static, inert gas—results in significant improvement to the "ideal", without substantial inhibition of the reaction. Moreover, I have also found, as discussed in my copending applications, that by choice of better reaction conditons, even this insubstantial detriment to reaction rate, due to increased magnesium vapor pressure, can be readily compensated for. Thus, I have found that by the use of highly active reducing alloys coupled with certain slag compositions, the reaction pressure of the magnesium vapor may be increased more than to compensate for the increased pressure needed for diffusion of the magnesium through the substantially static inert gas.

The present invention should also be contrasted to those systems where an inert gas is used to "sweep" a product vapor from a reaction zone, or to maintain the reaction zone at atmospheric pressure, in a "solid-state" system. See, for example, Fouquet, U.S. Pat. No, 2,558,744, where high pressure inert gas is passed laterally through a solid-state vertical reaction zone as a current of gas which sweeps magnesium vapor through an orifice into a condensation chamber. See also the similar process of Eisenberg et al., U.S. Pat. No. 3,427,152, also a solid-state process, where a countercurrent stream of heated hydrogen is used for heat transfer and acts to sweep the magnesium from the kiln. A similar process was apparently being referred to in the Moschel et al. reference supra, where solid dolomite was reduced by silicon, and a stream of hydrogen was used.

This "sweeping" of gas through solid reactants involves a distinguishable procedure from that of the present invention, where inert gas, maintained substantially above a molten slag, is substantially static, and where the magnesium is transferred by diffusion. The inert gas "sweep" procedure presents several insuperable problems which make it unsuitable for a molten electrothermic process, as contrasted with the solid-state process, and necessarily it cannot obtain the high-purity product of the present invention.

The present process is also different from those that employ an inert gas, generally intermittently and in small amounts, to purge impurities or to flush parts of the system, see e.g., Artru et al., U.S. Pat. No. 2,971,833; and Bretschneider et al., U.S. Pat. No. 3,017,263. Such procedures may be used in conjunction with the present process, if desired, but my present invention contemplates the use of the substantially static atmosphere of inert gas substantially throughout the reaction.

The magnesium transfer by diffusion in the present process has the effect of decreasing the agitation of the slag by reducing the volume per unit weight of evolving magnesium vapor. Also, due to both the higher pressure and the substantially static inert gas, the volumetric velocity of the magnesium through the duct to the condenser is decreased. Consequently, dusting, referred to above, is substantially depressed, and its deleterious effect on magnesium product purity and operation efficiency is significantly diminished.

While the above decrease in dusting may be achieved by operational procedures different from the present invention, such as careful preparation and charging of the magnesium ore and reducing alloy, the decrease of metallic impurities in the magnesium product has no counterpart of like efficiency, (cf. Bretschneider et al., supra).

The substantially static inert gas provides a partial barrier to the magnesium vapor mass transfer, which in turn requires an increased partial pressure of magnesium vapor in the reaction zone in order to maintain an equivalent flow to the condenser. This increased magnesium back pressure tends to retard the above reaction, somewhat decreasing the reaction rate, until the rate of magnesium production and the rate of magnesium vapor transfer to the condenser are in balance. This balance can be achieved, however, without substantially decreasing the production rate.

Further, it appears that, since the vapor pressures of the impurities remain fixed at a given temperature while magnesium pressure is increased in the present process, it follows that the impurities content in the magnesium product is decreased. This result is very favorable and quite unexpected. In retrospect, this decrease in impurities (especially of the heavier metals) also may be attributed in part to lower relative rates of diffusion through the static inert gas, but I do not wish to be held to any theory speculated as an explanation of the phenomenon.

In any event, the result overcomes a major deficiency of the present metallothermic process, namely, the high concentration of silicon in the product magnesium. By my process here described, I believe that the silicon content can be reduced to about 50–300 ppm—depending largely on the reaction conditions and silicon reducing alloy used—or to less than half of its present concentration in the Magnetherm product.

This decrease in silicon content is of course due in part to diminished dusting, i.e., carryover of silicon metal to the condensor. A comparable decrease of the other metallic impurities, such as manganese, tin and zinc, is not possible by diminished dusting—since they occur more by way of distillation. These impurities are also decreased, however, because of the relative decrease to their partial pressures, as mentioned above. Moreover, in view of the lower diffusivity of these latter contaminants as compared to magnesium and silicon, a substantial further decrease is also obtained. Consequently, the magnesium product of this invention contains less than 1500 ppm of total metallic impurities, or again less than that in the Magnetherm product. It is possible, furthermore, to reduce the impurities to even less than that in the electrolytic product.

In accordance with the present invention, magnesium is produced and vaporized in the presence of an atmosphere of substantially static inert gas which is at a partial pressure of at least 0.05 atmosphere, preferably, about 0.25 to 1.0 atmosphere. The pressure of the inert gas may be even higher, up to about 5 atmospheres, but in any event it should not be so high as to impair seriously the primary reaction, and therefore, the maximum pressure will of course depend on reaction conditions. The magnesium partial pressure immediately above the slag is at least about 0.05 atmosphere, and preferably as high as possible, up to about 1.5 atmospheres.

The potential partial pressure of the magnesium vapor in the reaction zone depends, of course, upon other conditions, primarily the temperature and composition of the slag bath, but also the concentration of magnesium oxide in it, the composition and concentration of the reducing agent, and the composition of the "spent" alloy. There is of necessity a pressure differential of the magnesium vapor between the furnace and the condenser to provide for the mass-transfer driving force for diffusing the magnesium vapor through the substantially static inert gas.

The total pressure of the system, including the partial pressure of both the magnesium and the inert gas, is at least 0.1 atmosphere, and preferably about 0.25 to 1.5 atmosphere. Ordinarily, the partial pressure of the inert gas in the condenser need not be higher than one atmosphere (or slightly less) in order that the absolute pressure of the system be about one atmosphere. But, if desired, the absolute pressure may be higher, and the partial pressure of the inert gas may be correspondingly higher. It may be advantageous to increase the absolute pressure of the system above 1 atmosphere, for example, in order further to decrease the metallic impurities, or to assist the periodic removal of spent by-products or magnesium from the system. It appears that there is no real advantage in having the inert gas partial pressure, or the absolute pressure of the system, higher than about 5 atmospheres.

The magnesium oxide reactant may comprise magnesia, usually derived from magnesite by calcination, or calcined dolomite an equimolar combination of magnesium oxide and calcium oxide, or mixtures of both. Other ores of magnesium oxide, such as serpentine, may be used also, but these are not preferred. In order to enhance the reaction, the magnesium oxide content of the system should be maintained relatively high, above 2 percent and preferably between about 5 and 25 percent, measured as a fraction by weight of the oxidic slag.

The metallic reducing agent may be silicon, aluminum, aluminum-silicon, ferrosilicon-aluminum, calcium-silicon, calcium-aluminum-silicon or the like. Preferably, silicon metal or an aluminum-silicon alloy containing silicon and aluminum in a ratio of at least 0.8:1, is employed. High utilization of the silicon is possible with such alloys. Apparently, the presence of aluminum in close physical association with the silicon stimulates the reductant synergistically, and a major fraction of the silicon may be utilized to reduce the magnesium oxide. Scrap aluminum may be used, and it may be added to provide part of the reducing agent. As employed herein the terms "aluminum", "silicon" and "aluminum-silicon alloy" include those reductants which, when added to the molten slag in the reaction zone of a reducing furnace, as herein described, provide metallic aluminum, silicon or both. In order to obtain such reducing agents, silicon metal may be combined in the reaction zone with small amounts of scrap aluminum, although it is preferable to alloy the two metals before feeding the reductant to the furnace. Thus, "aluminum" includes scrap aluminum metal, and "aluminum-silicon alloy"includes a mixture of silicon metal and aluminum metal.

For economic reasons, in part, a ferrosilicon alloy may be preferred, for example, a ferrosilicon-aluminum alloy containing about 0–25 percent iron, 40–65percent silicon and 25–50 percent aluminum, particularly in view of the ready availability of such aluminum-silicon alloys. Such alloys can be manufactured by electric furnace smelting procedures, which are well known. As the aluminum content of the alloy increases, a small proportion of iron is desirable or, at times, even necessary in order to prevent excessive volatilization of aluminum and silicon from the furnace. It is generally considered that the aluminum content of these alloys is for practical reasons limited to about 60 percent maximum. In such cases the iron content is generally greater than about 5 percent. On the other hand, for maximum utilization of the silicon content, it is desirable to have a relatively low iron content in the reductant of this invention. But this desideratum must be balanced against the favorable effect of iron content on the cost of producing the reductant alloy, as mentioned above. An iron content of about 10 percent appears to be satisfactory considering these factors, but it may be higher or lower without departing from the spirit of the invention, for example in the range of 0 to 25 percent. As is well known, titanium and other metallic oxides are sometimes present in the raw materials used for the production of an aluminum-silicon alloy, and the corresponding metal is therefore sometimes present in the alloy produced. The presence of such "tramp" metals does not interfere with the operation of the process of this invention, and may be tolerated or remedied by suitable metallurgical procedures.

Another preferred reducing alloy is high-silicon, that is an alloy containing about 80–99.75 percent silicon, 0.25–15 percent iron and 0–20 percent aluminum. High-silicon has a particularly favorable effect on the promotion of the reaction, as demonstrated in my application filed concurrently herewith, now Pat. No. 3,681,053.

The oxidic slag generally contains a mixture of calcium, aluminum and silicon oxides, sometimes called a calcium-aluminum-silicate or lime-alumina-silica slag, in combination with the magnesium oxide reactant. One or more of these oxides may of course be a product of the reaction, depending on the reductant used, which could, along with the consumption of magnesium oxide, control the slag composition as the reaction proceeds. The composition of the slag in any case is about 10–60 percent calcium oxide, 0–35 percent aluminum oxide, 20–50 percent silica and 2–25 percent magnesium oxide, as measured after removal from the reaction zone. An absence of alumina would occur, of course, only if aluminum is not present in the reductant. In this instance, or where the alumina content would otherwise be lower than desired, alumina may be added to the slag as such, or as bauxite or clay.

The temperature of the slag, and hence of the system, depends primarily on the slag composition (i.e., it must be molten) but the temperature is usually at least 1300° C., and preferably about 1400°–1700° C. In the process of the present invention it is highly desirable to maintain in the reaction zone a temperature of at least about 1400° C. to promote good reaction conditions, but temperatures higher than about 1700° C. are undesirable because they create difficult engineering and operating problems. It is therefore desirable to employ a slag whose melting point is not higher than about 1600° C. in order that enough superheat may be applied to impart sufficient fluidity to the slag without the necessity of excessively high temperature. Thus, a temperature of about 1400–1700° C. in the reaction zone is preferred although in certain instances higher or lower temperatures are suitable and may be desired.

It is noteworthy that, on the other hand, slags of relatively high viscosity can be used in the present process because there need be in the furnace no bed of solid material through which the slag must find its way in order to reach the tap hole for removal. Thus, the problem of slag viscosity is not as great as it is in most metallurgical processes, but it is still a factor requiring attention.

In general, the composition of the slag is determined primarily in the present process by the ratio of aluminum to silicon as reductant, which for reasons of economy should be as high as feasible; the relative proportions of magnesuim oxide fed as magnesia and as dolomitic lime or as other ores; and the amount of alumina (if any) used as a flux.

Ordinarily, diffusion of magnesium vapor alone is sufficient to provide for the mass transfer from the reactor to the condenser. However, if desired, a stream of the inert gas may be introduced into the furnace and fed through the condenser, in order to augment the magnesium flow to the condenser, in which case a recycle system is desirably utilized to recover the inert gas. In any event, as defined above, the inert gas is to be substantially static, and the magnesium vapor mass transfer, predominately by diffusion.

Even with these restrictions, however, I have found that control of the flow of the substantially static gas, from static up to a flow rate equal to the relative rate of magnesium, provides a ready means of control for the reaction system. As mentioned above, the inert gas provides a partial barrier to the flow of magnesium vapor to the condenser—requiring an increased partial pressure of magnesium above the slag—until a point of balance is reached of the magnesium production and diffusion rates. As inert gas is caused to flow together with the magnesium vapor, this barrier begins to drop, and consequently the need for increased magnesium pressure decreases. In other words the magnesium diffusion rate is promoted by the moving inert gas. Other factors remaining equal, the magnesium production rate increases. Further, since there is no corresponding decrease in partial pressure of the vaporized impurities, the impurities content of the product is raised somewhat.

Thus, control of the flow of inert gas provides considerable control over the production of magnesuim by the present method. Control over production rate and product purtiy may be achieved. For example, the same combination of magnesium ore, reductant, slag and operating conditions can be used, by means of such control, to produce either high-purity magnesium or magnesium having somewhat lower purity, where high purity is not essential. Similarly, the inert gas flow can be adjusted in order to facilitate start-up, for example by promoting the reaction at high flow and then by cutting back towards a static atmosphere as the ideal conditions are approached in the reaction-condensation zone.

Consequently, a preferred method of operating the present process is a method of controlling the level of impurities in the product magnesium of a metallothermic process for producing magnesium by the reduction of magnesium oxide, wherein magnesium oxide and a metallic reducing agent react in the presence of a molten oxidic slag bath, and magnesium vapor is evolved from a reaction zone to a condensation zone predominately by diffusion, in the presence of a substantially static atmosphere of inert gas, and wherein the molal flow rate of the inert gas from the reaction zone to the condensation zone is less than the molal flow rate of the magnesium vapor, and which includes providing means to control the flow rate of the inert gas.

In the operation of a process such as has been described, small amount of impurities in the raw materials fed to the system (e.g., residual $CO_2$ and $H_2O$ in the oxidic portion of the charge, and air trapped with the raw materials in the feed hoppers) may find their way into the furnace and produce gases, such as $H_2$ or CO, which should be vented from the system. These gases may be removed as required by bleeding off the inert gas, in which they will be present as impurities, in order to prevent an undesirable buildup of pressure.

The operation of the present process under relatively high absolute pressure significantly decreases the leakage of air into the system. This degree is advantageous, since the presence of air results in the reaction of oxygen and nitrogen with the magnesium product not only to decrease yield but also to form accretions of solid matter on the system walls. In particular the decrease of solids deposited on the heat transfer surfaces substantially increases the condenser efficiency and extends the period between shutdowns. Moreover, a high absolute pressure, particularly as atmospheric pressure is approached, makes it possible to operate the process as a continuous or semi-continuous process, with attendant benefits, such as facilitating removal of spent slag, spent alloy and magnesium product. Further, even if a batch process is used, the need for a hermetically sealed reaction-condensation system is diminished —and problems, such as vacuum breaking, may be avoided—completely, or at least to a significant extent.

I claim:

1. A process for the production of magnesium in a reaction-condensation system in which magnesium oxide and a metallic reducing agent react in the presence of a molten oxidic slag to evolve magesium vapor from a reaction zone to a condensation zone, and which includes the provision of a substantially static atmosphere of inert gas in the vapor space of the reaction-condensation zone, and wherein transfer of magnesium vapor from the reaction zone to the condensation zone takes place predominately by diffusion through said inert gas.

2. The process of claim 1, wherein the substantially static atmosphere of inert gas comprises hydrogen, helium, argon or mixtures thereof.

3. The process of claim 1, wherein the metallic reducing agent is aluminum, silicon or an aluminum-silicon alloy.

4. The process of claim 1, wherein the partial pressure of the inert gas in the system is at least 0.05 atmosphere.

5. The process of claim 1, wherein the absolute pressure of the system is about 0.25 to 1.5 atmospheres.

6. The process of claim 1, wherein to control the relative flow rate of inert gas from the reaction zone to the condensation zone is controlled.

7. The process of claim 6, wherein inert gas is removed from the condensation zone and recycled to the reaction zone.

8. A metallothermic process for the production of magnesium, comprising charging magnesium oxide and a metallic reducing agent into a moltem oxidic slag in a reaction zone of a reaction-condensation system, reducing the magnesium oxide under conditions such that magnesium vapor is evolved, removing the magnesium vapor to a condensation zone and condensing and collecting a magnesium product, and which includes the provision of an inert gas atmosphere in the vapor space of the system at a partial pressure of at least 0.05 atmosphere, and wherein the molal flow rate of magnesium vapor from the reaction zone to the condensation zone is greater than the molal flow rate of the inert gas.

9. The metallothermic process of claim 8, wherein the partial pressure of the inert gas in the condensation zone is greater than the partial pressure of the magnesium vapor in the reaction zone.

10. The metallothermic process of claim 8, wherein the atmosphere of inert gas is substantially static and the removal of magnesium vapor to the condenser zone takes place predominately by diffusion through said inert gas.

11. The metallothermic process of claim 8, wherein the molal flow rate of magnesium vapor is at least twice the molal flow rate of the inert gas.

12. The metallothermic process of claim 8, wherein the inert gas comprises hydrogen, helium, argon or mixtures thereof.

13. The metallothermic process of claim 8, wherein the metallic reducing agent is aluminum, silicon or an aluminum-silicon alloy.

14. The process of claim 8, wherein the absolute pressure of the system is about 0.25 to 1.5 atmospheres.

15. The process of claim 8, wherein the relative flow rate of inert gas from the reaction zone to the condensation zone is controlled.

16. The process of claim 8, wherein inert gas is removed from the condensation zone and recycled to the reaction zone.

17. A method of controlling the level of impurities in the product magnesium of a metallothermic process for producing magnesium by the reduction of magnesium oxide, wherein magnesium oxide and a metallic reducing agent react in the presence of a molten oxidic slag bath, and magnesium vapor is evolved from a reaction zone to a condensation zone predominately by diffusion, in the presence of a substantially static atmosphere of inert gas, and wherein the molal flow rate of the inert gas from the reaction zone to the condensation zone is less than the molal flow rate of the magnesium vapor, and which includes controlling the flow rate of the inert gas.

18. The method of claim 17, wherein inert gas is removed from the condensation zone and recycled to the reaction zone.

19. The method of claim 17, wherein the partial pressure of the inert gas in the condensation zone is greater than the partial pressure of the magnesium vapor in the reaction zone.

20. The method of claim 17, wherein the molal flow rate of magnesium vapor is at least twice the molal flow rate of the inert gas.

21. The method of claim 17, wherein the inert gas comprises hydrogen, helium argon or mixtures thereof.

22. The method of claim 17, wherein the metallic reducing agent is aluminum, silicon or an aluminum-silicon alloy.

* * * * *